US006101904A

United States Patent [19]

Freitas

[11] Patent Number: 6,101,904

[45] Date of Patent: Aug. 15, 2000

[54] FLANGE REMOVAL AND INSTALLATION TOOL

[75] Inventor: Michael D. Freitas, North Providence, R.I.

[73] Assignee: Freitas Industries, Inc., Providence, R.I.

[21] Appl. No.: 09/192,947

[22] Filed: Nov. 16, 1998

[51] Int. Cl.[7] ..... B25B 13/06

[52] U.S. Cl. ..... 81/121.1; 81/124.6

[58] Field of Search ..... 81/3.4, 120, 121.1, 81/124.6

[56] References Cited

U.S. PATENT DOCUMENTS

| | | | |
|---|---|---|---|
| 739,895 | 9/1903 | Melcher | 81/120 |
| 983,562 | 2/1911 | Murray . | |
| 2,357,562 | 9/1944 | Thom et al. . | |
| 2,522,038 | 9/1950 | Houghton | 81/120 X |
| 2,651,230 | 9/1953 | Waterval . | |
| 2,940,344 | 6/1960 | Taylor . | |
| 2,959,994 | 11/1960 | Kile | 81/3.4 X |
| 3,635,106 | 1/1972 | Homs . | |
| 4,181,048 | 1/1980 | Norton . | |
| 4,237,755 | 12/1980 | Gunnell, III . | |
| 4,982,629 | 1/1991 | Germain . | |
| 5,499,561 | 3/1996 | Quinn . | |
| 5,862,721 | 1/1999 | Lowats | 81/121.1 |

*Primary Examiner*—James G. Smith
*Attorney, Agent, or Firm*—Barlow, Josephs & Holmes, Ltd.

[57] ABSTRACT

An improved flange removal tool is provided to facilitate the installation and removal of pipe flanges from a receiving pipe fitting. The flange tool includes a body portion with an upper surface which includes a central opening for receiving an engagement head of a socket wrench. A continuous frame is attached to the body portion by spaced arms such that the continuous frame is suspended in spaced relation from the lower surface of the body portion by a distance which is greater than the thickness of a pipe flange to be rotated. The pipe flange is positioned between the body portion and the frame so upon rotation of the flange tool, facilitated by engagement of a socket wrench with the central opening, side walls of the spaced arms contact the edges of the pipe flange to urge rotation thereof and threading onto its receiving pipe fitting. A number of different sizes of pipe flanges can be accommodated by the flange tool of the present invention without changing the operation of the tool or engagement of the bolt apertures of the pipe flange.

4 Claims, 7 Drawing Sheets

FLANGE REMOVAL AND INSTALLATION TOOL

BACKGROUND OF THE INVENTION

The present invention relates generally to tools for the installation and removal of flanges which are fitted to pipes and other related pipe fittings. More specifically, the present invention relates to tools which facilitate the installation and removal of circulator flanges to pipes and related pipe fittings for subsequent installation of complementary fittings and components thereto.

In the plumbing and heating industry, the installation of flanges to pipe members is very common. In particular, flanges are installed onto pipes and other pipe fittings to enable a pump or other like unit be installed inline with such pipes or pipe fittings. The two opposing sections of pipe, which receive the pump unit therebetween, are each fitted with flange members to interface with corresponding flanges on the pump unit. Once in place between the pipe flanges, the pump is secured in place with bolts in the usual fashion.

The use of such pipe flanges in the plumbing industry necessitates installation and removal of the actual pipe flange member which interfaces with the unit to be installed in-line. Due to the configuration of the pipe flange itself, threaded installation and removal thereof is difficult and awkward. Further, when access to the pipe flange is limited, as in tightly-spaced locations, installation and removal of a pipe flange is made even more difficult.

Several attempts have been made in the prior art to address the aforementioned problems associated with the installation and removal of pipe flanges to pipes and other pipe fittings. For example, U.S. Pate. No. 4,237,755, issued to Gunnell, III, which is incorporated herein by reference, discloses a pipe flange tool for tightening and removing threaded pipe flanges. The Gunnell patent provides a base with at least three pins to accommodate two different sizes of pipe flanges and corresponding hole configurations. In Gunnell, two of the three pins are used at a give time to accommodate the particular flange at hand. The operation of the Gunnell tool must be modified to accommodate pipe flanges of different sizes.

In view of the foregoing, there is a demand for a flange removal tool which can effectively install and remove pipe flanges even in tight spaces and without engagement of the bolt apertures in the pipe flange itself. In addition, there is a demand for a flange removal tool which can accommodate a range of sizes of pipe flanges without requiring modification of the tool itself or the operation thereof. Further, there is a demand for a flange removal tool which uses a conventional socket wrench to manipulate the flange tool.

SUMMARY OF THE INVENTION

The present invention preserves the advantages of plumbing and heating flange tools. In addition, it provides new advantages not found in currently available flange tools and overcomes many disadvantages of such currently available tools.

The invention is generally directed to a novel and unique flange tool with particular application in installing and removal of flanges from pipe fittings. The flange tool of the present invention enables the simple and easy installation and removal of flanges from pipe fittings by use of a conventional socket wrench without fear of injury to the user or damage to the flange itself. In addition, the flange tool of the present inventions, can accommodate flanges of different pipe sizes without changing the operation or configuration of the tool.

The preferred embodiment of the flange removal tool of the present invention includes a body portion having an upper surface and a lower surface. The upper surface includes a central opening for receiving an engagement head of a socket wrench for rotation of the body portion. Depending downwardly from the lower surface of the body portion are a pair of spaced arms. A continuous frame, having a peripheral edge margin, generally corresponds to an outer edge margin of a pipe flange to be rotated and manipulated. The flange, having a thickness, is received in the frame which is attached to the spaced arms such that the continuous frame is suspended in spaced relation from the lower surface of the body portion by a distance which is greater than the thickness of the flange.

The flange tool of the present invention is employed to rotate a pipe flange on a receiving pipe fitting, such as a male threaded pipe. In that connection, the flange tool of the present invention may be employed to install, remove, tighten or loosen a pipe flange on its receiving pipe fitting. To install a pipe flange with the flange tool of the present invention, the pipe flange is preferably partially hand threaded onto its receiving pipe fitting. A socket wrench is then inserted into the central opening on the flange tool. The flange tool is then positioned over the pipe flange to be tightened so that the pipe flange resides between the frame and the body portion. The socket wrench is rotated in a clockwise direction so that the edges of the pipe flange engage the side walls of the downwardly depending arms. Further rotation of the socket wrench further rotates the pipe flange to effectuate further threading onto the receiving pipe fitting. For removal of the pipe flange, the process is reversed whereby the socket wrench is rotated in a counter-clockwise direction to unthread the pipe flange from the receiving pipe fitting.

It is therefore an object of the present to provide a flange tool which is safe to use.

Another object of the present invention is to provide a flange tool which does not damage the flange member itself.

It is a further object of the present invention to provide a flange tool which is used with a conventional socket wrench.

It is a further object of the present invention to provide a flange tool which is not susceptible to slippage from the flange to be manipulated.

It is yet another object of the present invention to provide a flange tool which can fit into tight spaces.

Another object of the present invention is to provide a flange tool which can accommodate pipe flanges of different sizes without adjustment or modification of the tool itself or the operation thereof.

BRIEF DESCRIPTION OF THE DRAWINGS

The novel features which are characteristic of the present invention are set forth in the appended claims. However, the inventions preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
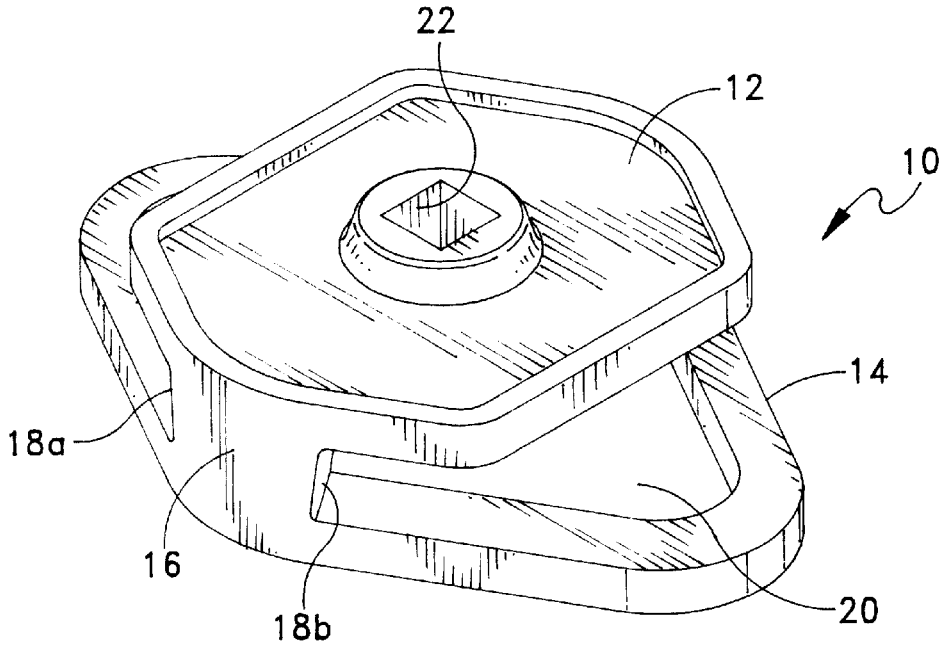
FIG. 1 is a perspective view of the flange tool in accordance with the present invention.
Figure 2:
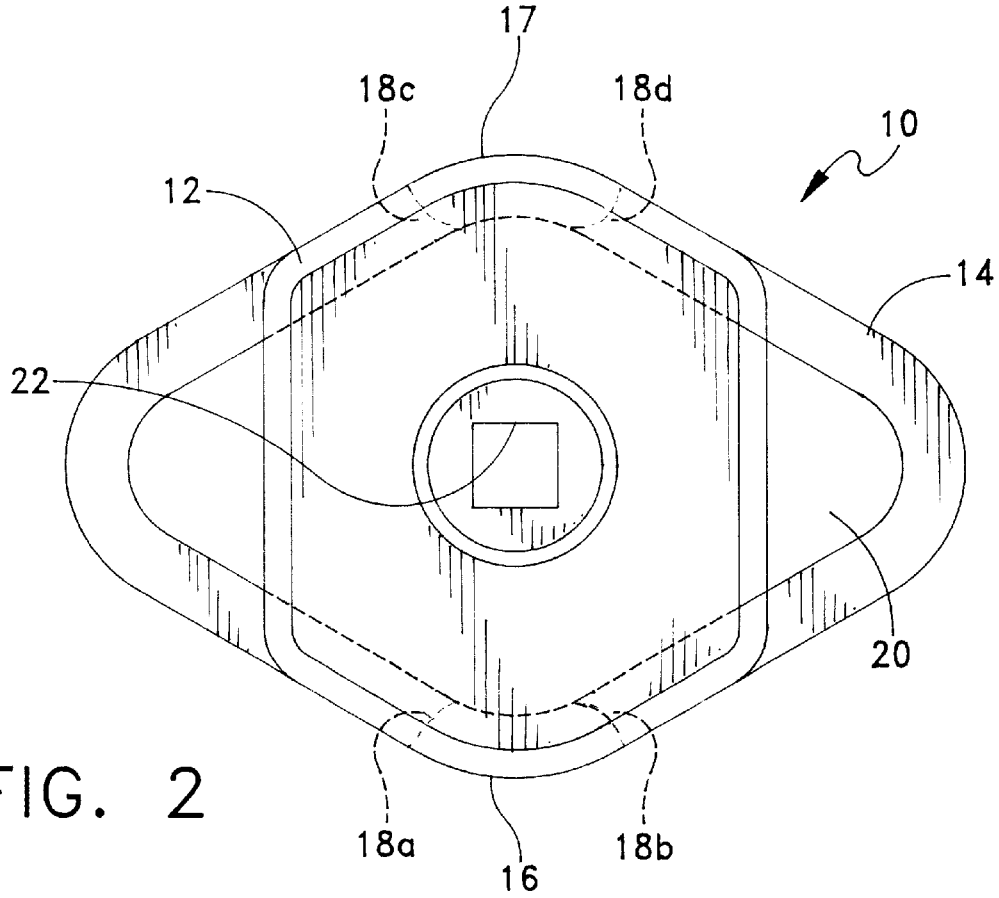
FIG. 2 is a top view of the flange tool shown in FIG. 1.

Referring to FIGS. 1 and 2, a perspective view of the flange tool 10 of the present invention is shown. In particular, flange tool 10 includes a substantially planar upper body 12 with a socket wrench receiving aperture 22 therein. A lower frame 14 is provided with a generally diamond-shaped pass-through aperture 20. Lower frame 14 is connected to upper body 12 by a pair of connecting arms 16 and 17 with corresponding angled side walls, referenced as 18*a–d*.

In FIG. 2, a plan view of the flange tool 10 of the present invention is shown. As will be discussed in detail below, lower frame 14 is of a general diamond shape to accommodate the substantial diamond shape of a pipe flange to be manipulated. FIG. 2 specifically shows the general layout and configuration of upper body 12 relative to lower frame 14. Lower connecting arm 16 is provided with a left side wall 18*a* and a right side wall 18*b*. Further, top connecting arm 17 is provided with left side wall 18*c* and right side wall 18*d*.

Figure 3:
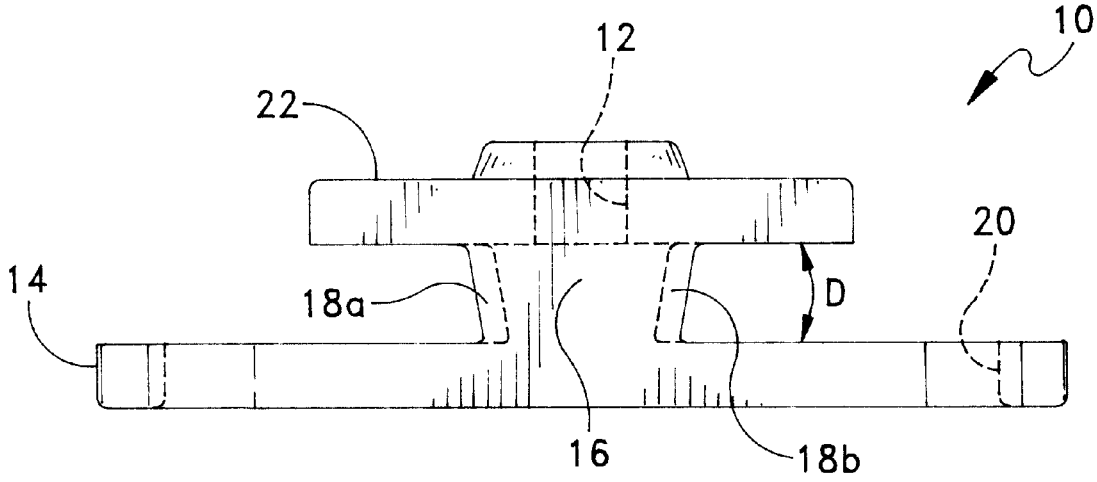
FIG. 3 is a front elevational view of the flange tool shown in FIG. 1.
Figure 4:
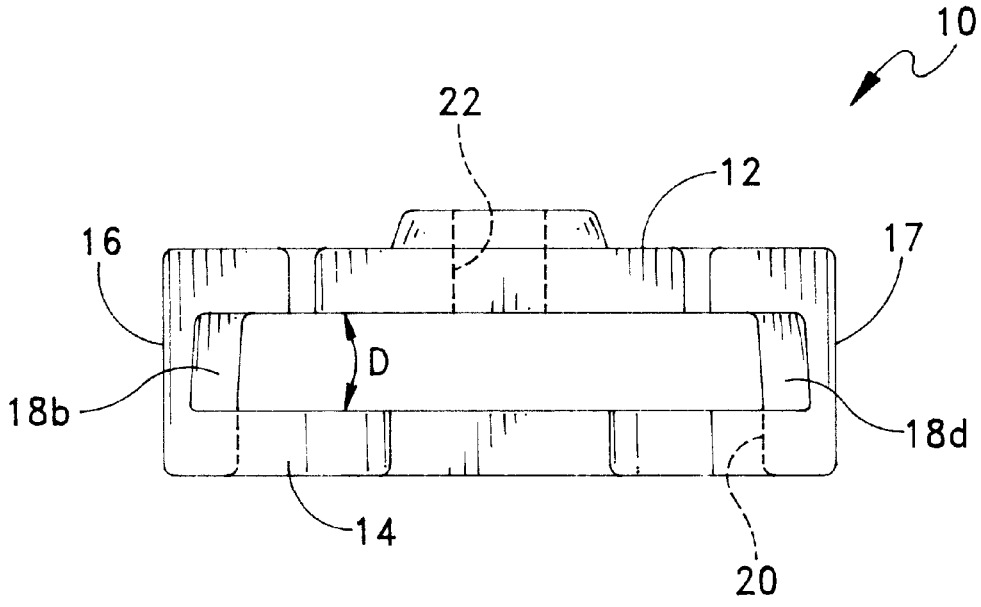
FIG. 4 is an end elevational view of the flange tool shown in FIG. 1.

FIGS. 3 and 4 show a front elevational view and end elevational view, respectively, of the flange tool 10 of the present invention. Referring both to FIGS. 3 and 4, upper body 12 is positioned at a distance D from lower frame 14 by the connecting arms which are generally referenced as 16.

Figure 5:
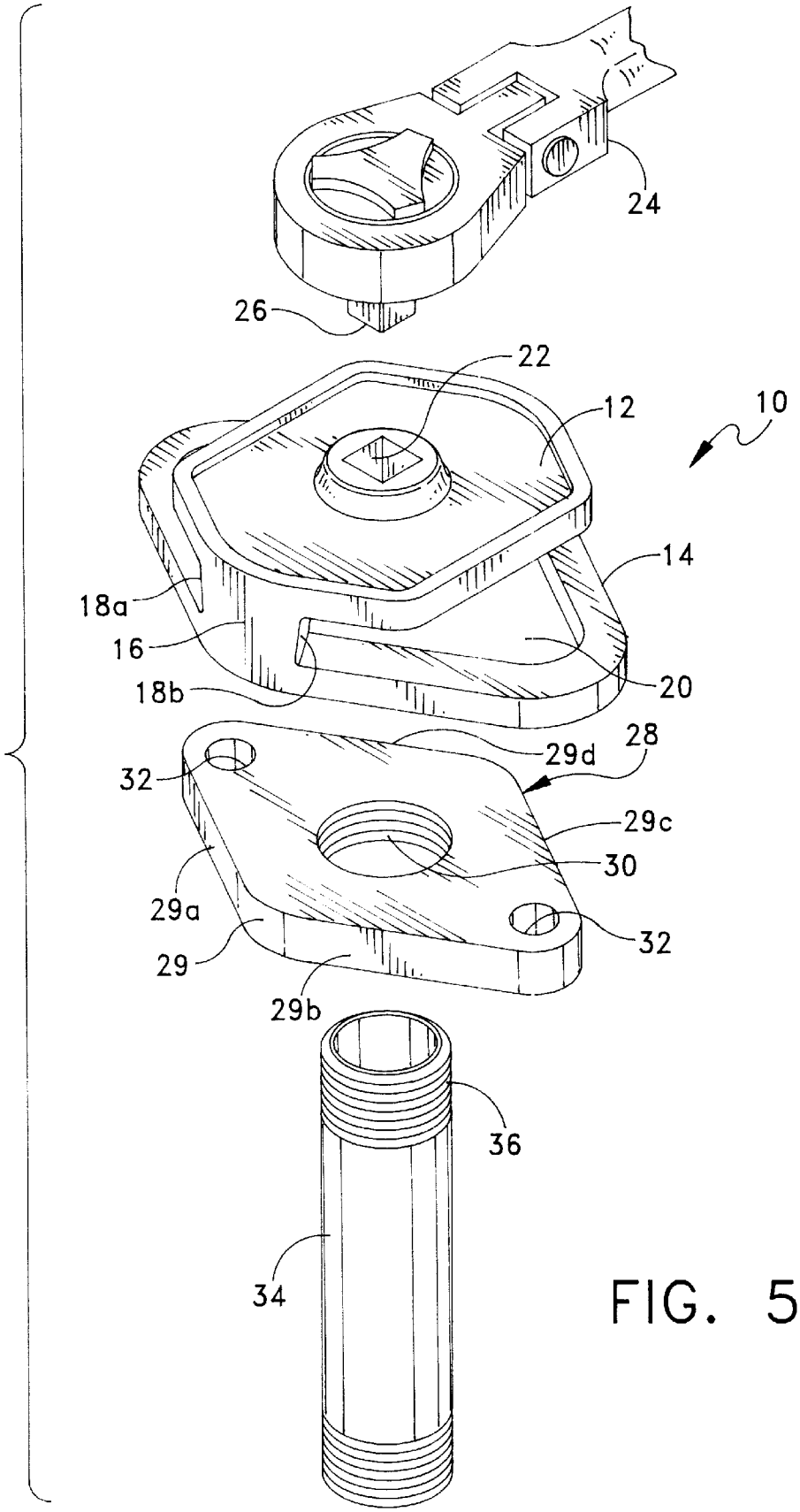
FIG. 5 is an exploded perspective view of the installation and use of the flange tool shown in FIG. 1.
Figure 6:
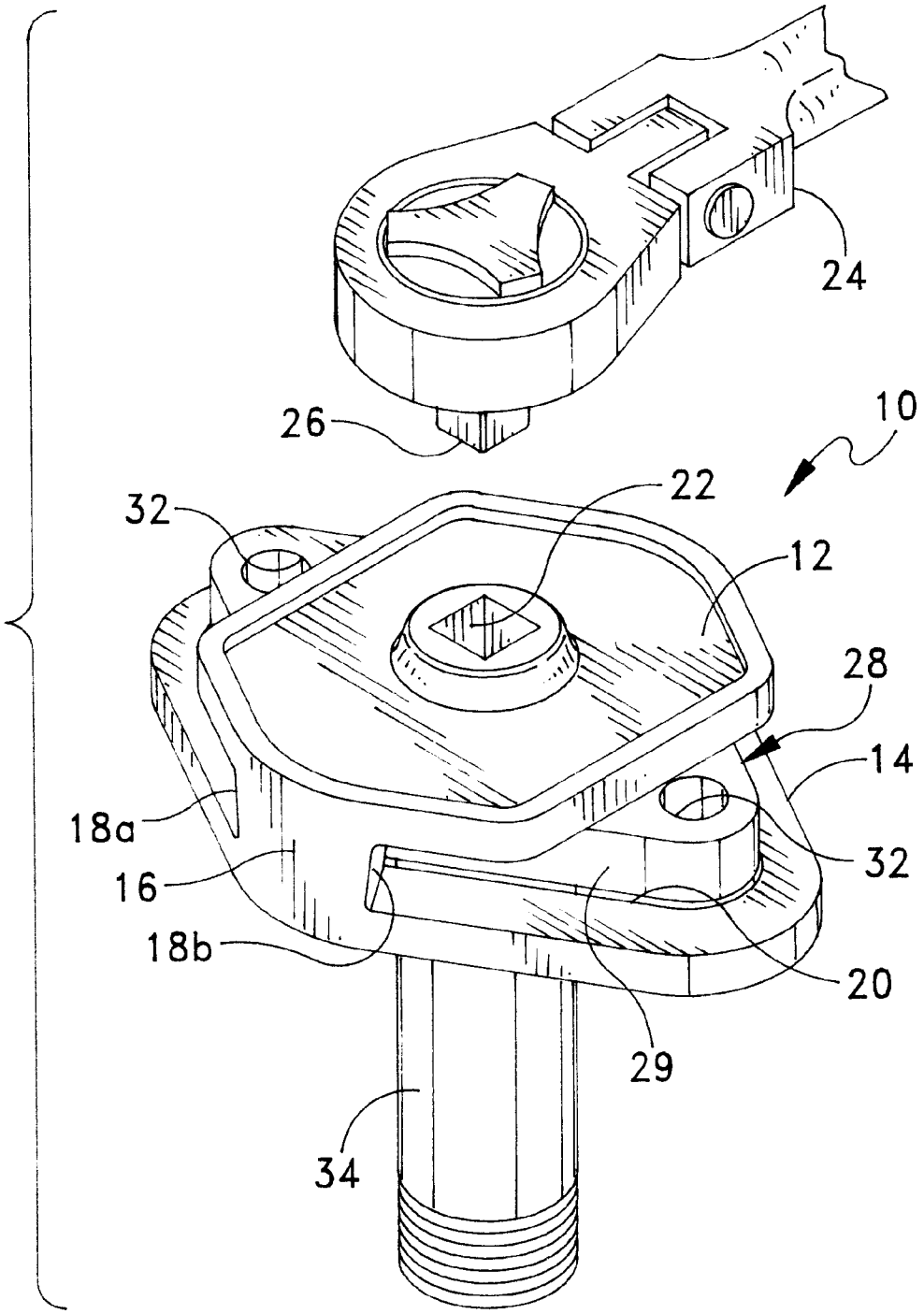
FIG. 6 is a perspective view of the initial installation of the flange tool prior to engagement of the socket wrench.

FIG. 5 illustrates an exploded perspective view of the entire assembly, employing tool 10, in accordance with the present invention. In particular, a common pipe fitting 34 is provided with male threading 36 thereon for threadably receiving diamond-shaped pipe flange 28 via female threaded bore 30. Pipe flange 28 includes an edge generally referenced as 29. More specifically, the diamond-shaped pipe flange 28 includes edges 29*a*, 29*b*, 29*c*, and 29*d*. Further, bolt holes 32 are provided for receiving an in-line plumbing unit, such as a pump, or the like. Such connection is not described herein as it relates to a common plumbing installation well known in the art. The present invention relates to the removal and installation of pipe flange 28 to pipe fitting 34.

Further, flange tool 10 is positioned over pipe flange 28 so that lower frame 14 is substantially aligned over pipe flange 28. The side end configuration of lower frame 14 is substantially identical to that of pipe flange 28. However, as will be described in detail below, pipe flange 28 may vary in size but is at least of a configuration slightly smaller than pass-through aperture in frame 14 to permit pipe flange 28 to be accommodated between lower frame 14 and upper body 12. In addition, the distance between upper body 12 and lower frame 14 is set to be slightly larger than the thickness of pipe flange 28 to accommodate such a pipe flange 28 therebetween. A socket wrench tool 24 is also provided with a wrench head 26 which is capable of removable engagement with socket wrench receiving aperture 22. The employment of socket wrench tool 24 facilitates the rotation of flange tool 10 and thus the manipulation of pipe flange 28 on pipe fitting 34.

Figure 7:
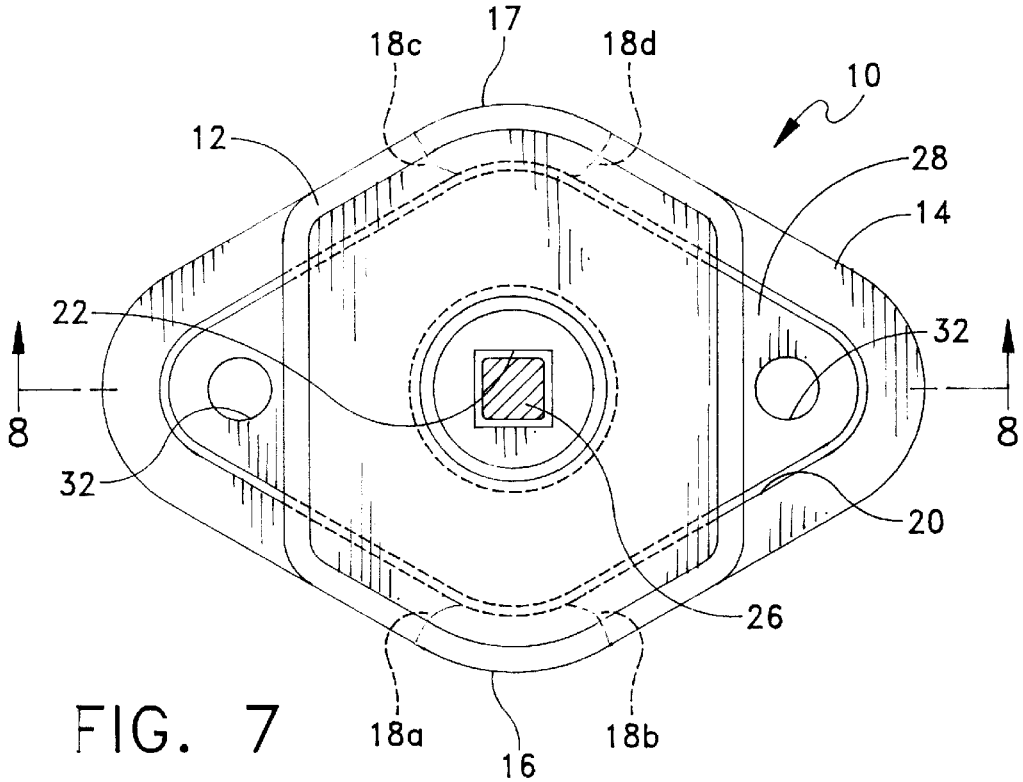
FIG. 7 is a top view of the arrangement shown in FIG. 6.
Figure 8:
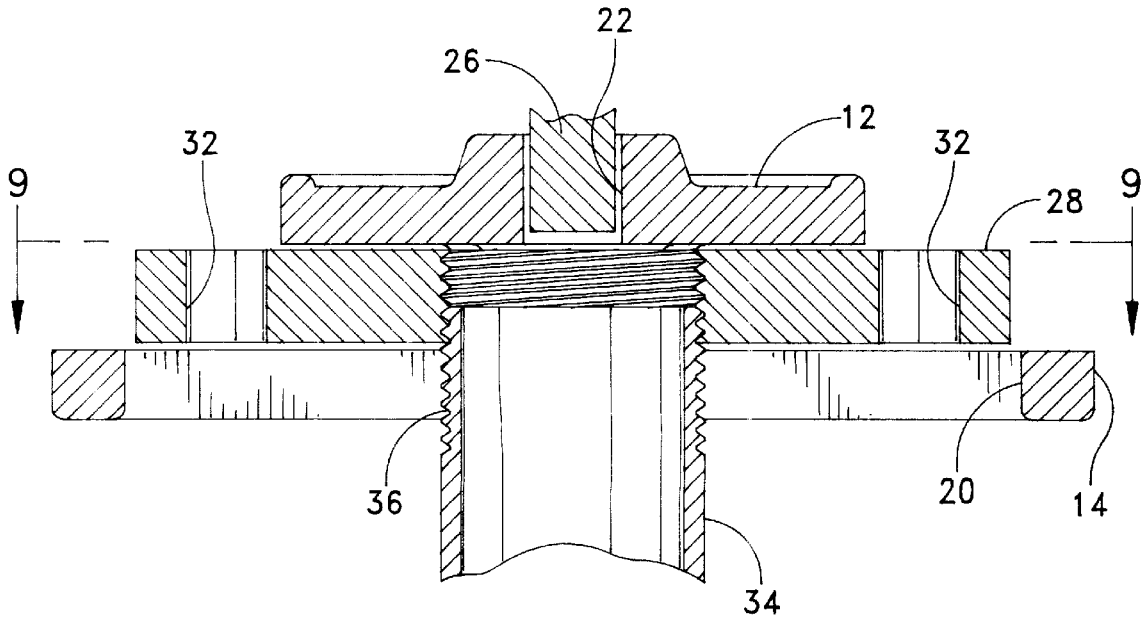
FIG. 8 is a cross-sectional view through the line 7—7 of FIG. 7.

The engagement of flange tool 10 with pipe flange 28 is illustrated in detail in FIGS. 6–9. In particular, flange tool 10 is positioned over pipe flange 28 so that the body of pipe flange 28 is routed into pass-through aperture 20 in frame 14 so as to reside substantially between upper body 12 and lower frame 14. As seen in FIG. 7, lower frame 14 is configured to be of a diamond shape which is slightly larger than the diamond-shaped body of pipe flange 28 to facilitate the routing therethrough. FIG. 8 illustrates a cross-sectional view through the line 8—8 of FIG. 7 where pipe flange 28 is threaded onto pipe fitting 34 at threads 36 and is residing between upper body 12 and lower frame 14.

Figure 9:
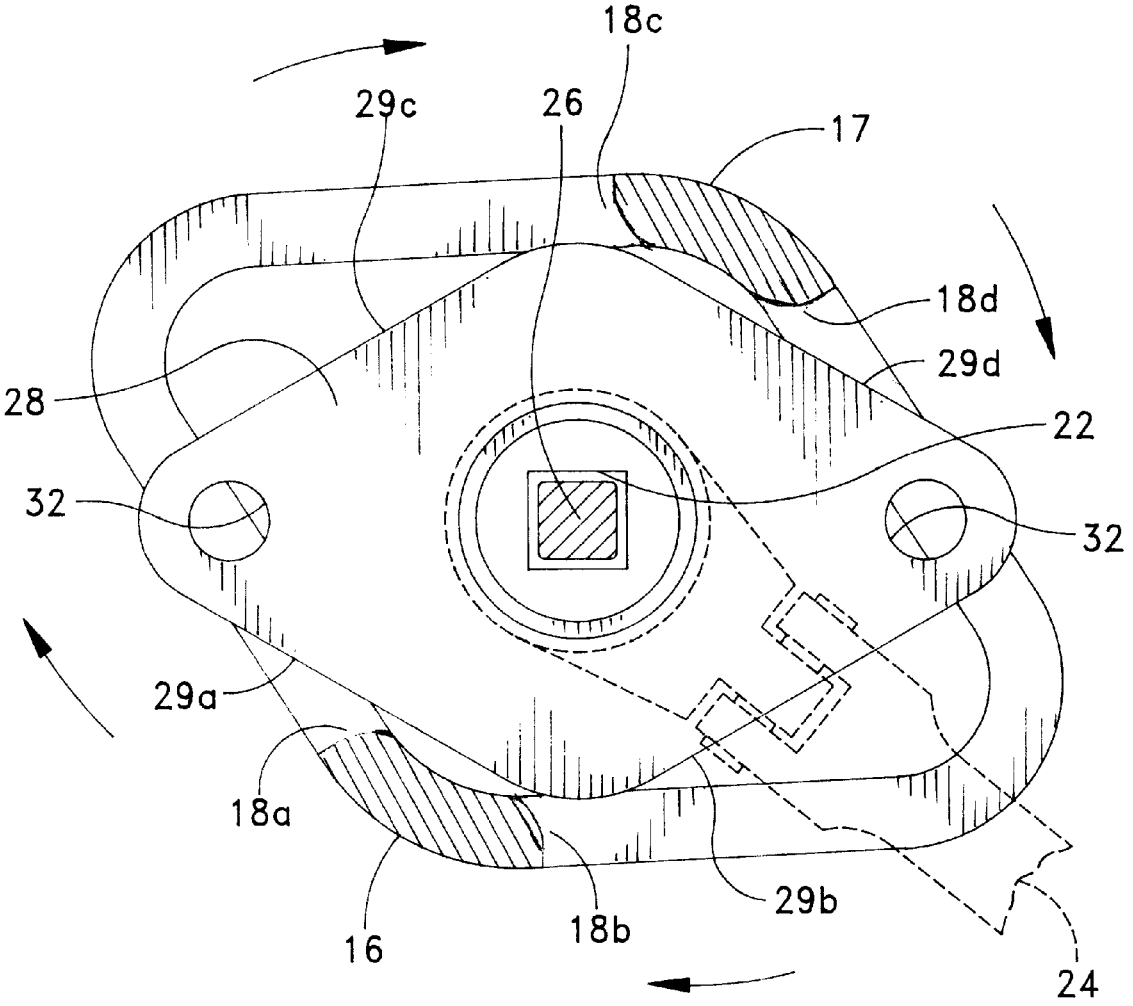
FIG. 9 is a top view of the flange tool of the present invention during the actual flange removal process.

Turning now to FIG. 9, a bottom view of the assembly at lines 9—9 of FIG. 8, is shown to illustrate the rotational manipulation of pipe flange 28 on pipe fitting 34. In particular, FIG. 9 illustrates the clockwise rotation of flange tool 10, facilitated by wrench 24 and engagement of wrench head 26 with socket wrench receiving aperture 22. In FIG. 9, the clockwise rotation of flange tool 10 results in the unthreading and subsequent removal of pipe flange 28 from pipe fitting 34.

In particular, FIG. 9 illustrates the rotation of flange tool 10 so that sides, generally referenced as 29, of flange tool 10 move between upper body 12 and lower frame 14 to ultimately contact an edge 18 of connecting arms 16. In particular, as shown in FIG. 9, clockwise rotation of flange tool 10 causes side wall 29*a* of pipe flange 28 to contact angled side wall 18*a* of connecting arm 16. Simultaneously, opposing side wall 29*d* of pipe flange 28 bears upon side wall 18*d* of connecting arm 17. In general, the rotation of flange tool 10 relative to pipe flange 28 causes two opposite sides 29*a–d* to bear upon corresponding two of opposing side walls 18*a–d*. Further, for the installation or threading of the pipe flange 28 onto pipe fitting 34, flange tool 10 is rotated in a counter-clockwise fashion whereby edge 29*b* communicates with side wall 18*b* of arm 16 while opposing edge 29*c* communicates with side wall 18*c* of opposing connecting arm 17.

In view of the foregoing, the flange tool 10 of the present invention effectuates rotation of pipe flange 28 by engagement and communication of opposing edges of pipe flange 28. As a result of this engagement, a wide array of sizes of pipe flanges 28 can be accommodated by the present invention. More specifically, since it is the side walls 18*a–d* which engage and communicate with edges 29*a–d*, as opposed to bolt holes 32, pipe flanges 28 of differing lengths can still be accommodated by the present invention and effectively rotated as desired. The pipe flange 10 of the present invention can accommodate a range of pipe flanges 28 which are in a range of slightly smaller than lower frame 14 down to an overall length of a pipe flange 28 which is slightly greater than the distance between an opposing set of side walls 18*a* and 18*d* or 18*b* and 18*c* to ensure that connecting arms 16 and 17 can still embrace and effectively rotate pipe flange 28. Since the flange tool 10 of the present invention does not engage with bolt holes 32 as in the prior art, a wider range of pipe flanges 28 can be accommodated without modifying the method of use or the flange tool 10 itself.

For removal of a pipe flange 28 from a pipe fitting 34, in accordance with the present invention, the flange tool 10 is typically first placed over the pipe flange 28 itself and may be left to rest in place with the aid of continuous lower frame 14 to prevent the tool from slipping off pipe flange 28. Wrench 24 is then installed into socket wrench receiving aperture 22. With the aid of socket wrench 24, flange tool 10 is rotationally manipulated in the appropriate direction to either thread pipe flange 28 onto pipe fitting 34 or vice versa depending on whether installation or removal of pipe flange 28 is desired. Further, the continuous configuration of lower frame 14 provides an additional measure of safety in the event slippage occurs during the rotation of pipe flange 28. It is not uncommon for a pipe flange installation to be in a tight space with poor accessibility resulting in inferior gripping onto the pipe flange 28 itself. If such slippage does occur, the continuous lower frame 14 prevents the entire flange tool 10 from being ejected completely off of pipe flange 28 which could result in injury to the user.

Figure 10:
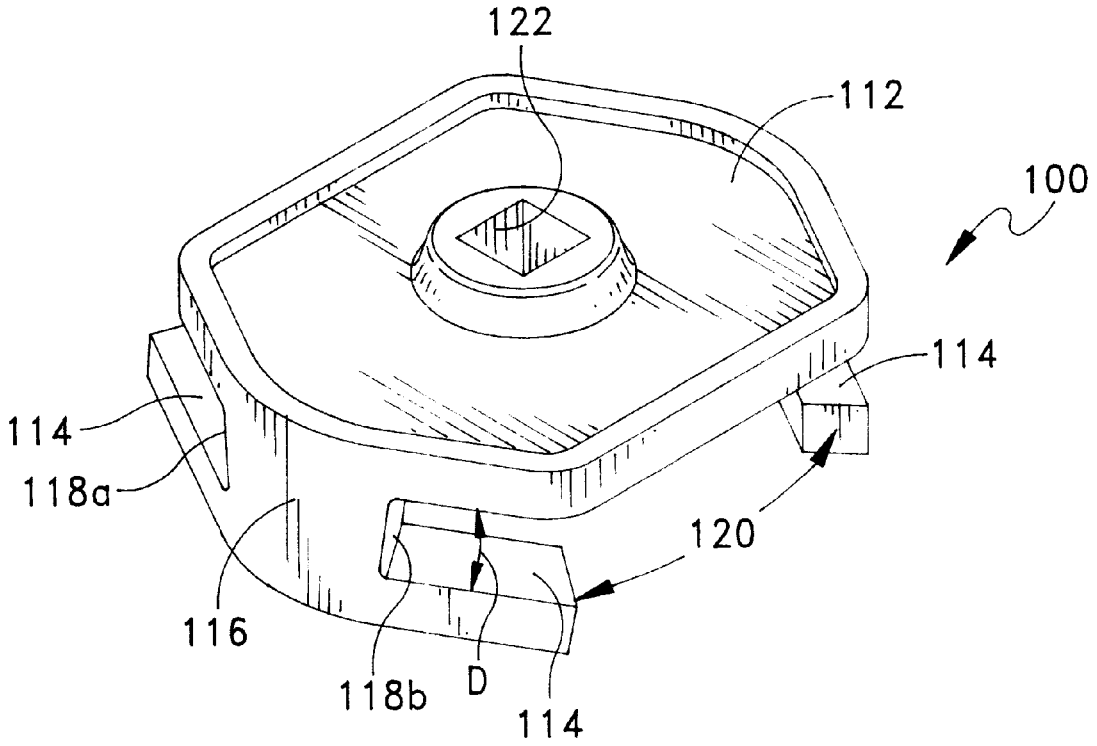
FIG. 10 is a perspective view of an alternative embodiment of the flange tool in accordance with the present invention.

FIG. 10 illustrates an alternative embodiment 100 of the flange tool of the present invention. In particular, upper body 112 is provided at a distance D from a series of legs 114 which emanate outwardly from arms 116 which downwardly depend from upper body 112. Alternative embodiment 100 is different than the preferred embodiment 10 in FIGS. 1–9 in that lower frame 14 is broken into a series of outwardly projecting legs 114. Legs 114, essentially, provide a discontinuous lower frame for the purposes of accommodating pipe flanges in extremely tight spaces where it is necessary for the flange tool 100 to be directly and laterally installed into space designated D without first being routed through pass-through aperture 20 of frame 14 of the preferred embodiment. In such a tightly spaced installation, flange tool 100 is routed directly onto a pipe flange where the width of the pipe flange resides within region designated D and the pipe fitting onto which the pipe flange is installed passes through gap 120 between the free ends of outwardly extending legs 114. As discussed above, the alternative embodiment 100 of the present invention facilitates the actual installation of the tool of the present invention onto a pipe flange.

The present invention is preferably made of cast steel or other suitable metal for ruggedness and durability. The particular configuration of the flange tool 10 of the present invention can be modified significantly and still be within the scope of the present invention. For example, upper frame 12 may be modified in plan so as to be larger or smaller depending on the size of the pipe flange to be accommodated. Similarly, the configuration of lower frame 14 and legs 114 may be modified to accommodate pipe flanges of different sizes and configurations. In addition, wrench receiving aperture 22 in the preferred embodiment and aperture 122 in the alternative embodiment may be modified to accommodate different types of wrenches and other tools to facilitate the rotation of the flange tool 10 of the present invention.

It would be appreciated by those skilled in the art that various changes and modifications can be made to the illustrated embodiments without departing from the spirit of the present invention. All such modifications and changes are intended to be covered by the appended claims.

What is claimed is:

1. A flange tool for rotating a flange on the end of a pipe, said flange having an outer peripheral edge margin and a thickness, said flange tool comprising:

a planar body portion having an upper surface and a planar lower surface, said planar body portion further having a central axis and a longitudinal centerline, said upper surface having a central opening disposed along said central axis for receiving an engagement head of a wrench for rotation of said body portion about said central axis;

a pair of spaced arms extending downwardly from said planar lower surface of said body portion, said spaced arms being located along said longitudinal centerline and being symmetrically spaced from said central axis; and a planar continuous frame having an inner peripheral edge margin which is constructed to receive therein said outer edge margin of said flange, said continuous frame having a planar upper surfaces, said continuous frame being attached to said spaced arms such that said planar upper surface of said continuous frame is positioned in parallel spaced relation from said planar lower surface of said body portion by a distance which is greater than said thickness of said flange, and further such that a planar opening is defined between the planar upper surface of said frame and the planar lower surface of the body portion, said flange being received through said frame so as to rest adjacent to said lower surface of said body portion, said flange tool being rotated relative to said flange such that said flange is captured in the planar opening between said upper surface of said frame and said lower surface of said body portion and further such that side walls of said spaced arms engage opposing side surfaces of said flange to rotate said flange.

2. The flange removal tool of claim 1, wherein said continuous frame is generally diamond in shape.

3. The flange removal tool of claim 1, wherein said arm portions are arcuate.

4. A flange tool for rotating a flange on the end of a pipe, said flange having an outer peripheral edge margin and a thickness, said flange tool comprising:

a body portion having an upper surface and a lower surface, said body portion further having a central axis and a longitudinal centerline, said upper surface having a central opening for receiving an engagement head of a wrench for rotation of said body portion about said central axis;

a pair of spaced arms extending downwardly from said lower surface of said body portion, said spaced arms being located along said longitudinal centerline and being symmetrically spaced from said central axis, said spaced arms having side engagement walls; and a plurality of legs attached to and emanating from said spaced arms such that said plurality of legs are suspended in spaced relation from said lower surface of said body portion by a distance which is greater than said thickness of said flange, and further such that an opening is defined between the legs and the lower surface of the body portion, said legs being arranged in a plane that is parallel to said lower surface of said body portion and being arranged in a non-continuous frame configuration that generally corresponds to said outer edge margin of said flange and said flange being received through said legs so as to rest adjacent to said lower surface of said body portion, said flange tool being rotated relative to said flange such that said flange is captured in the opening between said legs and said lower surface of said body portion and further such that said side engagement walls of spaced arms engage opposing side surfaces of said flange to rotate said flange.

* * * * *